US007048630B2

(12) United States Patent
Berg et al.

(10) Patent No.: US 7,048,630 B2
(45) Date of Patent: May 23, 2006

(54) SYSTEM FOR AND METHOD OF CAPTURING A PLAYER'S IMAGE FOR INCORPORATION INTO A GAME

(75) Inventors: Charles R. Berg, Cupertino, CA (US); Andrew S. Pascal, Burlingame, CA (US)

(73) Assignee: IGT, Reno, NV (US)

( * ) Notice: Subject to any disclaimer, the term of this patent is extended or adjusted under 35 U.S.C. 154(b) by 580 days.

(21) Appl. No.: 10/272,722

(22) Filed: Oct. 17, 2002

(65) Prior Publication Data

US 2003/0083132 A1 May 1, 2003

Related U.S. Application Data

(63) Continuation of application No. 09/551,034, filed on Apr. 17, 2000, now abandoned.

(51) Int. Cl.
*A63F 9/24* (2006.01)

(52) U.S. Cl. ..... 463/30; 463/16; 463/20

(58) Field of Classification Search ..... 463/1, 463/16, 30, 31, 43; 345/434, 118
See application file for complete search history.

(56) References Cited

U.S. PATENT DOCUMENTS 4,105,310 A 8/1978 Hirata et al.
4,688,105 A 8/1987 Bloch et al.
4,710,873 A 12/1987 Breslow et al.
5,012,522 A * 4/1991 Lambert ..... 382/118
5,397,133 A * 3/1995 Penzias ..... 463/22
5,423,554 A 6/1995 Davis
5,595,389 A * 1/1997 Parulski et al. ..... 463/31
5,905,807 A * 5/1999 Kado et al. ..... 382/118
5,984,780 A * 11/1999 Takemoto et al. ..... 463/20
6,072,523 A 6/2000 Zajfman et al.
6,120,379 A 9/2000 Tanaka et al.
6,142,876 A 11/2000 Cumbers
6,168,523 B1 * 1/2001 Piechowiak et al. ..... 463/26

* cited by examiner

*Primary Examiner*—Julie Brocketti
(74) *Attorney, Agent, or Firm*—Beyer Weaver & Thomas,LLP

(57) ABSTRACT

A method of capturing a player's image for incorporation into a casino game that comprises a reel or a reel simulation game including an array of frames comprises using a camera to capture the image of a player at the casino game who is located within the field of view of the camera, electronically sensing the image captured by the camera, and electronically displaying at least a portion of the electronically sensed image on a first electronic display associated with the casino game such that the displayed portion of the image is utilized within the play of the casino game at which the player is present.

20 Claims, 2 Drawing Sheets

SYSTEM FOR AND METHOD OF CAPTURING A PLAYER'S IMAGE FOR INCORPORATION INTO A GAME

This is a continuation of U.S. Ser. No. 09/551,034 filed Apr. 17, 2000 now abandoned, which is incorporated herein by reference in its entirety.

BACKGROUND OF THE INVENTION

The present invention generally relates to a system for and method of capturing a player's image for incorporation into a game, especially casino type wagering video game.

Many games such as casino video games, employ visual effects to enhance player excitement and enthusiasm. Some video enhancements include video simulation of spinning reels and "virtual" displays of live casino table games.

SUMMARY OF THE INVENTION

The present invention relates to a system and method of capturing an image of a player of a game and displaying the players's image in association with the game, such as on a screen of a casino video game machine. Preferably the player's image is utilized within the play of the game being played by the player.

BRIEF DESCRIPTION OF THE DRAWINGS

The present invention will be described with reference to the accompanying drawings, wherein.

BRIEF DESCRIPTION OF A PREFERRED EMBODIMENT

Figure 1:
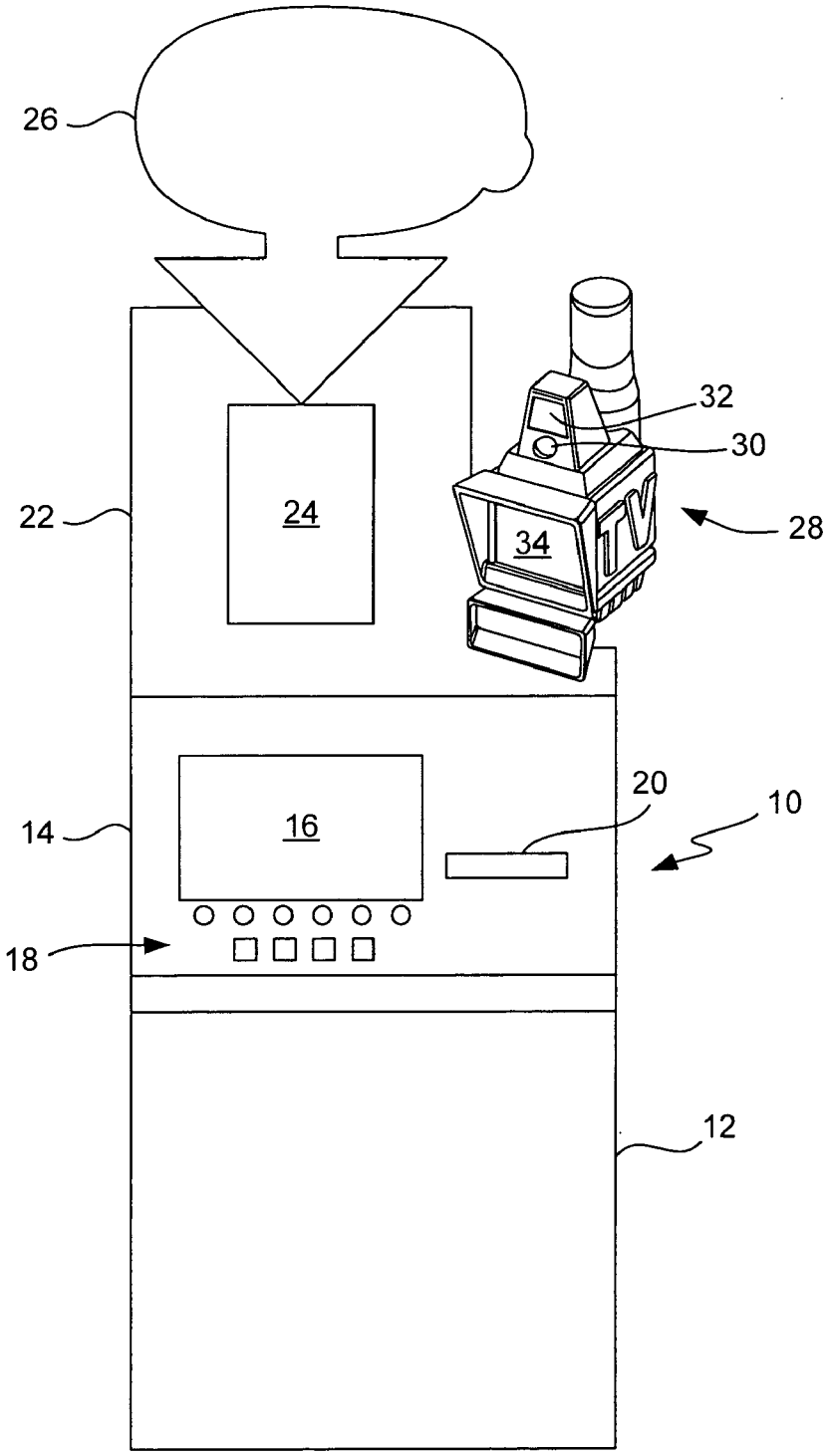
FIG. 1 is a schematic illustration of a front view of a casino video game machine in accordance with one embodiment of the present invention.
Figure 2C:
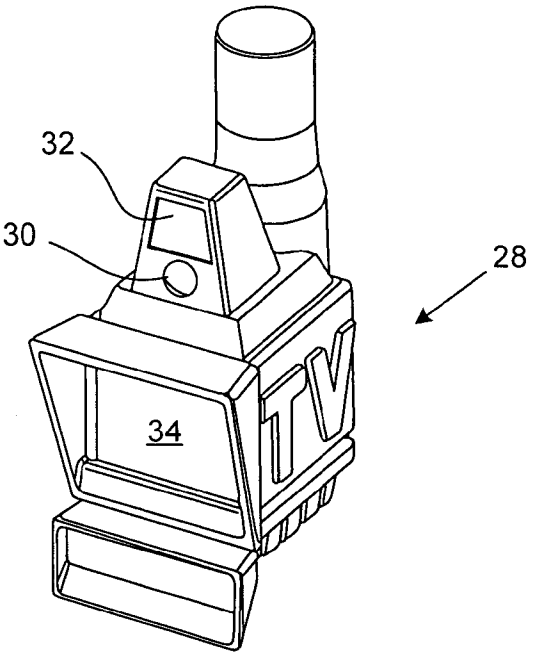
FIGS. 2*a, b,* and *c,* are front, side, and perspective illustrations of a TV camera system that may be utilized in an embodiment of the present invention.
Figure 2B:
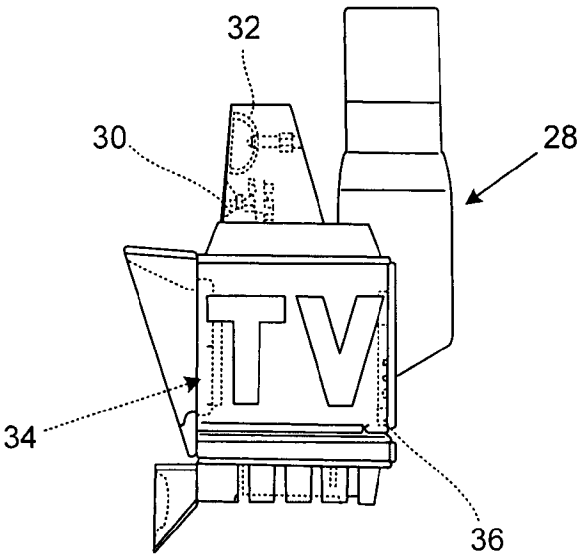
Figure 2A:
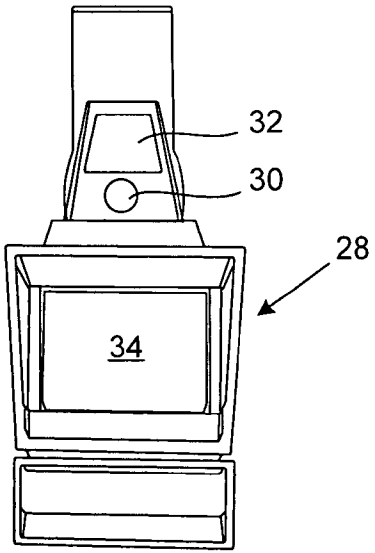

The present invention will be described with reference to the accompanying drawings wherein like reference numerals refer to the same item.

There is shown in FIG. 1 a casino video game machine 10 generally configured as a "slant top" machine in which a player usually sits on a stool or chair in front of the machine 10. It should be appreciated from a further reading of the preferred embodiment that the instant invention may be employed with a wide variety of games, however, such as "upright", stand alone video game machines, such as casino table games, and such as games played with a computer monitor and keyboard.

The machine 10 includes a generally boxed shaped base 12 that house electronics and other equipment used in the operation of the game. The machine 10 also includes a slanted section 14 that contains a main game video monitor 16, a series of game control buttons 18 (although the invention contemplates that touch screen, light pen, track ball, mouse, and other game control facilities may be utilized), and monetary acceptance devices 20, such as a bill validator, a coin comparator, and an electronic funds transfer device. The machine 10 also includes an upper display section 22 that may contain graphic displays, lights, and a second video monitor 24. A display sign 26 may be mounted on top of the machine 10.

In addition to the foregoing features, the game machine 10 according to a preferred embodiment of the present invention includes a TV camera 28, which includes generally a video camera 30, a light source 32, an LCD display 34, and an LCD driver board 36. The TV camera 28 is preferably mounted above the slanted section 14 of the machine 10 and is generally oriented toward the area where a player's head and face would usually be located during the play of the game. In a preferred embodiment, the video camera utilizes a 6 mm lens, a field of view of approximately 35 degrees vertical by 45 degrees horizontal, and a depth of focus that is infinite.

The LCD display 34 may be used to show preloaded still shots or motion pictures that either advertise the casino or the game, or are directed specifically toward the play of the game. For example, the LCD display 34 may show messages such as "Be A Winner", "Win A Jackpot", or "Big Buffet at Noon in the Squire Room" or may display motion pictures of entertainment groups performing at the casino or other activities associated with the casino. It is also contemplated within the broad scope of the instant invention that the TV camera may have a mode of operation as an informational kiosk which includes push button, touch screen, or other control systems by which a person may view a display of a map of the casino, information on various events happening at the casino, and similar information. It is also contemplated that the TV camera may include sound speakers and a system by which a person may communicate telephonically with a person in a hotel room of the casino, with the casino hotel concierge, with the casino staff to report problems with the machine, and with other persons for casino related matters.

The video camera 30 captures an image within the field of view of the lens of the video camera 30, which would usually include the head and face of a player who plays the machine 10. Instead of the image being captured on photographic film, the image is captured through an electronic sensor board (not shown). The images captured on the electronic sensor board may be selectively used for a variety of purposes, including verification of the identity of a player with a player tracking card used by the player of the machine 10 and including security purposes. In the preferred embodiment, he video camera 30 is used to capture a player's image on selected occasions during the player's play of the casino game on the machine 10. In a preferred embodiment, the player's image is replicated continuously in real time for a selected time interval on the LCD display 34 along with some sort of countdown, which may a display of numerals decreasing in value to 0 on the LCD display 34 or by a sound command, which may be a preloaded soundtrack of a person voicing the count down and giving similar instructions. At the end of the countdown, the player's image is used as a "still shot" and is replicated on at least one of the monitors 16, 24 for use in connection with the play of the game. It is contemplated that the player's "still shot" may be displayed on at least one of the monitors 16, 24 in a preselected location, that the player's image may be utilized as the "head" of an animated person or character appearing on the monitor 16, 24, or as a symbol on a series of simulated reels or cards appearing on the monitor 16, 24. The invention also contemplates that the player's image captured by the video camera 30 may be cropped so that only the player's head (and no background) is replicated on one of the monitors 16, 24. The image of the player captured by the video camera 30 either may be a "still shot" or may be continuously displayed in real time on at least one of the monitors 16, 24 or on another display in the casino.

The player's image may be utilized in the play of a primary game, or may be displayed only, or also, in connection with a secondary event or bonus game.

In an alternative embodiment, a player may push a button to initiate the taking of a still shot picture, or the player push button which permits a still picture of the player to be retaken if the player is dissatisfied with the initial still picture.

The invention also contemplates that the images of more than one player may be replicated in the play of the game. Thus, for example, if the game involves two boxers; outer space warriors, or car racers, then the images of multiple players may be correspondingly placed with an associated one of the characters in the game.

The present invention also contemplates that the player's image may be replicated on one or more display screens positioned so as to be readily viewed by other casino patrons at various locations around the casino, or in the display sign 26 located on top of the machine 10. If, for example, a player hits a jackpot or otherwise achieves a special event, then the player's image may be widely displayed for purposes of generating interest in the game and which for most players will give them the satisfaction of publicizing their success at the game.

The invention further contemplates that the player's image captured by the video camera 30 would also be relayed to the casino's security so that if a player makes an obscene gesture or the image is otherwise offensive, then the casino security may override the system and delete or cancel the display of the player's image. The invention may also employ an image recognition system that scans the image for features such as two eyes, a nose, a mouth, a chin, etc. and if the image does not contain such features or a preselected minimum number of such features, then the system will reject the image and not display the image.

It should be appreciated that the TV camera 28 may be mounted at a variety of locations in, on, about, or near the machine 10 and that the video camera 30 need not be positioned adjacent to the LCD display 34. The invention also contemplates that more than one video camera 30 may be utilized so that a preferred view of the player may be selected or so that a three dimensional image may be created and replicated on monitors and display screens.

Because the ambient light in the vicinity of a player may be insufficient to create quality contrast in the player's captured image, the TV camera 28 further includes a light source 32 that may be selectively activated to shine a predetermined intensity of light generally toward objects in the field of view of the video camera 30.

The present invention also contemplates that the still shot of the player's image may be replicated on photographic paper or other paper by means of a suitable printer. The machine 10, in such an embodiment, would include a source of such paper, a printer, and a dispenser so that the player may keep the printed image as a takeaway memento. The paper, printer, and dispenser may also be located at a remote location. Preferably the printed material includes not only the player's image, but also a recognizable feature, logo, or name of the game and the casino, the dollar value of the player's winnings, the player's name, and other information. If the player uses a player tracking card during the play of the game, then data from the card may be electronically transmitted to the printer for inclusion on the memento.

At a selected time, such as at the end of a round of play of the game, any player image being displayed would be erased.

The operation of an exemplary embodiment of the present invention will now be described. A player places an appropriate amount of money in the monetary acceptance device 20 and begins play of a video draw poker game in which the cards are displayed in the monitor 16 and in which the player implements his or her decisions concerning the play of the game through the control buttons 18. The player either gains credits or loses credits according to a preestablished payoff table based generally upon the poker rank of the hand achieved by the player. If the player achieves a very good poker hand, such as five of a kind (which may be achieved by using wild cards in a standard deck of 52 cards), then the player may be automatically enrolled in the play of a secondary event game or bonus game. At this time, the monitors 16, 24 may flash various messages concerning the bonus game, and lights, bells, whistles, and other attention getting signals may be activated. Soon thereafter, a preloaded motion picture of a person pretending to be a motion picture director appears on the LCD display 34 and announces (through the sound systems associated with the machine 10 or the TV camera 28) that the player is going into a bonus round and enthusiastically commands the player to get ready to have his or her picture taken. The producer then begins a countdown such as "ready, set, go" or "five, four, three, two, one, zero". During the countdown, the light source 32 is activated, and the player's image is captured by the video camera 30 and replicated on at least a portion of the LCD display 34, such as within an oval shaped area appearing centrally on the LCD display 34. During the countdown, the player can see his or her image replicated on the LCD display 34 and can adjust his or her position, smile, and otherwise arrange themselves in a desirable pose. At the end of a countdown, a still shot of the player's image is taken and replicated on at least a portion of the monitor 16, again, which may be in an oval shaped area on the monitor 16. The player then plays a secondary event or bonus game, which, for example, may be a game of "Family Feud", by which the player may win additional credits. The secondary event game may be played on either of the monitors 16, 24 or both of the monitors 16, 24. At the end of play of the secondary event game, the player's image is erased from the system and disappears from both the LCD display and the monitors 16, 24.

It is to be understood, that even though numerous characteristics and advantages of the present invention have been set forth in the foregoing description, together with details of the structure and function of the invention, the disclosure is illustrative only, and changes may be made in detail, especially in matters of shape, size and arrangement of parts or types, of material within the principles of the invention to the full extent indicated by the broad general meaning of the terms in which the appended claims are expressed.

Although particular embodiments of the present invention have been described and illustrated herein, it should be recognized that modifications and variations may readily occur to those skilled in the art and that such modifications and variations may be made without departing from the spirit and scope of the invention. Consequently, the invention as claimed below may be practiced otherwise than as specifically described above.

We claim:

1. A method of capturing players' images in real-time for incorporation into an electronic casino game comprising a reel simulation or an electronic casino card game, wherein the electronic casino game comprises multiple player capability and further comprises a playing portion associated with each player, the method comprising:

receiving a value payment from each of a plurality of players;

providing a notification to the plurality of players that their images will be captured, wherein the notification comprises at least one of a visual signal and an audible signal;

using a camera to capture real-time images of each of the players who are located within a field of view of the camera;

scanning the real-time images for facial features, wherein the facial features comprise at least one of a chin, a nose, a mouth and eyes;

rejecting the real-time images if the real-time images do not include a minimum number of facial features;

cropping the unrejected real-time images to create cropped images consisting essentially of images of players' faces without any background images;

electronically displaying in real-time at least a portion of the cropped images on a video display associated with the casino game such that the cropped image of each player's face is combined with a video depiction of a figure to create a video character image associated with each player, wherein the video character image associated with each player comprises a video depiction of the player's face imposed on the video depiction of the figure and is displayed in the playing portion associated with each player;

freezing the cropped images to create still images of each player; and displaying the still images of each player on the video display.

2. A method according to claim 1, additionally comprising notifying the player when the captured image will be electronically sensed via a sound signal that comprises an electronically generated human voice simulation.

3. A method according to claim 1, additionally comprising electronically displaying at least a portion of the electronically sensed image on a second electronic display associated with the game.

4. A method according to claim 1, where the casino game additionally comprises a plurality of cameras.

5. A method according to claim 1, where the casino game includes a light source to provide additional light on each of the players when necessary to obtain the images of the players.

6. A method according to claim 1, further comprising allowing a player to elect to have the image printed on a printer coupled to the casino game.

7. A method according to claim 1, further comprising comparing the image to an image associated with a player tracking card used by the player.

8. A method of capturing a player's image in real-time for incorporation into an electronic casino game comprising a reel simulation or an electronic casino card game, wherein the electronic casino game comprises a playing portion, the method comprising:

receiving a value payment from a player;

providing a notification to the player that his image will be captured, wherein the notification comprises at least one of a visual signal and an audible signal;

using a camera to capture real-time images of the player who is located within a field of view of the camera;

scanning the real-time images for facial features, wherein the facial features comprise at least one of a chin, a nose, a mouth and eyes;

rejecting the real-time images if the real-time images do not include a minimum number of facial features;

cropping the unrejected real-time images to create cropped images consisting essentially of images of the player's face without any background images;

electronically displaying in real-time at least a portion of the cropped images on a video display associated with the casino game such that the cropped image of the player's face is combined with a video depiction of a figure to create a video character image associated with the player, wherein the video character image associated with the player comprises a video depiction of the player's face imposed on the video depiction of the figure and is displayed in the playing portion associated with each player;

freezing the cropped images to create still images of the player; and displaying the still images on the video display.

9. A method according to claim 8, additionally comprising notifying the player when the captured image will be electronically sensed via a sound signal that comprises an electronically generated human voice simulation.

10. A method according to claim 8, additionally comprising electronically displaying at least a portion of the electronically sensed image on a second electronic display associated with the game.

11. A method according to claim 8, where the casino game additionally comprises a plurality of cameras.

12. A method according to claim 8, where the casino game includes a light source to provide additional light on each of the players when necessary to obtain the images of the players.

13. A method according to claim 8, further comprising printing the image on paper with a logo indicative of the gaming establishment.

14. A method according to claim 8, further comprising comparing the image to an image associated with a player tracking card used by the player.

15. A method of capturing an image of a player for incorporation into an electronic casino game comprising a reel simulation or an electronic casino card game, wherein the electronic casino game comprises a playing portion associated with a player, the method comprising:

receiving a value payment from the player;

providing a notification to the player that his images will be captured, wherein the notification comprises at least one of a visual signal and an audible signal;

using a camera to capture an image of the player who is located within a field of view of the camera;

scanning the image for facial features, wherein the facial features comprise at least one of a chin, a nose, a mouth and eyes;

rejecting the image if the image does not include a minimum number of facial features; and electronically displaying at least a portion of an unrejected image on a video display associated with the casino game such that the unrejected image is combined with a video depiction of a figure to create a video character image comprising a video depiction of the player imposed on the video depiction of the figure and is displayed in the playing portion associated with the player.

16. A method according to claim 15, additionally comprising notifying the player when the captured image will be electronically sensed via a sound signal that comprises an electronically generated human voice simulation.

17. A method according to claim 15, where the casino game additionally comprises a plurality of cameras.

18. A method according to claim 15, where the casino game includes a light source to provide additional light on each of the players when necessary to obtain the images of the players.

19. A method according to claim 15, further comprising allowing a player to elect to have the image printed on a printer coupled to the casino game.

20. A method according to claim 15, further comprising comparing the image to an image associated with a player tracking card used by the player.

* * * * *